United States Patent [19]

Sérou et al.

[11] Patent Number: 4,651,378

[45] Date of Patent: Mar. 24, 1987

[54] FLOOR CLEANING OR TREATMENT MACHINE

[75] Inventors: Charles M. Sérou, Opfikon-Glattbrugg; Peter Brunner, Wallisellen, both of Switzerland

[73] Assignee: Diethelm & Co. AG, Zürich, Sweden

[21] Appl. No.: 840,094

[22] Filed: Mar. 17, 1986

[30] Foreign Application Priority Data

Mar. 20, 1985 [CH] Switzerland ..... 1239/85

[51] Int. Cl.[4] ..... A47L 11/162

[52] U.S. Cl. ..... 15/49 R; 51/177; 74/194

[58] Field of Search ..... 15/49 R, 50 R, 98, 385; 51/177; 74/194

[56] References Cited

U.S. PATENT DOCUMENTS 2,113,475 4/1938 Faber ..... 15/49 R
2,508,411 5/1950 Lundquist ..... 15/50 R
2,870,468 1/1959 Barel ..... 15/49 R
3,875,814 4/1975 Steuer ..... 74/194

FOREIGN PATENT DOCUMENTS 1550842 11/1966 Fed. Rep. of Germany .

*Primary Examiner*—Edward L. Roberts
*Attorney, Agent, or Firm*—Werner W. Kleeman

[57] ABSTRACT

A drive train is situated between an electric motor and a rotatable support disk to which an exchangeable cleaning or treatment implement or tool is fastened. In order to prevent overloading of the motor as well as to optimally adapt the speed of rotation of the support disc to operating conditions, especially the surface properties of the floor, the drive train possesses a friction transmission drive, in particular a friction wheel drive. This friction transmission drive automatically alters the rotational speed of the support disc in accordance with the torque required by it with a constant driving torque of the motor.

10 Claims, 6 Drawing Figures

Fig. 5
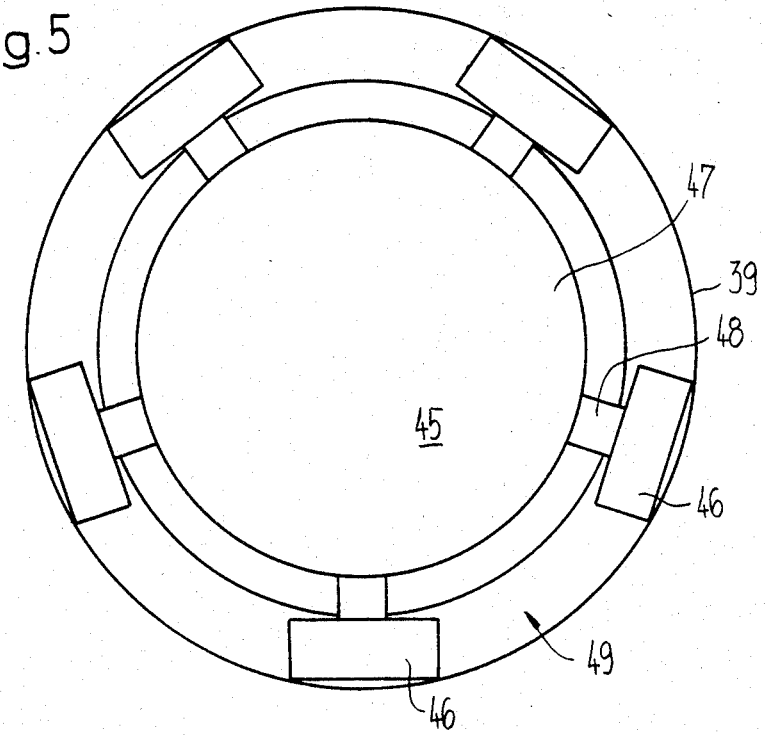
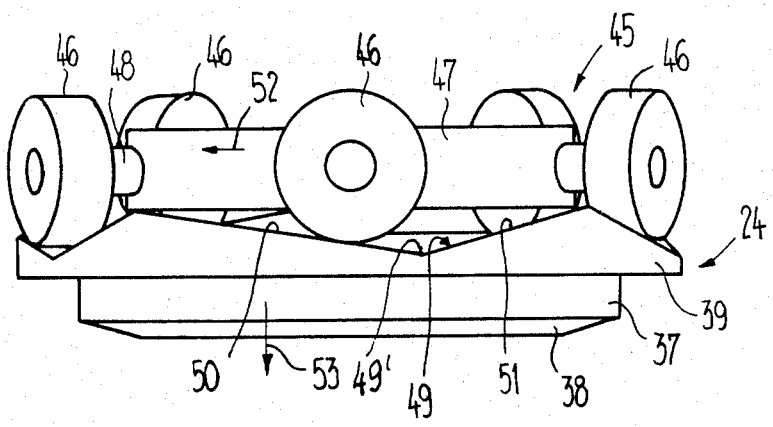
Fig. 6

FLOOR CLEANING OR TREATMENT MACHINE

BACKGROUND OF THE INVENTION

The present invention broadly relates to a new and improved construction of a floor cleaning or treatment machine.

In its more specific aspects the present invention relates to a new and improved construction of a floor cleaning or treatment machine possessing at least one rotatably drivable support disc which is driven by means of a motor, such as an electric motor, through a drive train. The support disc holds an exchangeable cleaning or treatment tool or implement.

Conventionally, and depending on the desired floor treatment operation, various cleaning or treatment tools, for example, disc brushes or roller brushes of various grades of hardness, polishing discs or rollers, or even abrasive discs can be fastened to the rotatable support disc of such a machine. Experience has shown that for each of these tools there exists an optimal rotational speed range for each floor treatment operation to be carried out and these ranges of rotational or rotary speed are often different.

Additionally, the surface properties of the floor to be cleaned or treated which, together with the tool being used, are of importance for the resisting moment or torque to be overcome by the motor, i.e. for the operating torque transmitted by the support disc to the tool. Machines of the abovementioned type are now available whose single speed of revolution renders them suitable for only one type of operation. Therefore, with such prior art machines the whole spectrum of desired floor treatment operations cannot be optimally covered.

In order to overcome this disadvantage and also to prevent overloading of the motor or the power supply network feeding it, it has been proposed to install, for example, a two-speed transmission in the drive train between the motor and the support disc or to provide a pole-switchable motor.

Nevertheless, this solution is not satisfactory, since—besides leading to complicated operation—such machines offer only two relatively narrow speed ranges for the support disc, and overloading of the motor is also not entirely precluded.

SUMMARY OF THE INVENTION

Therefore, with the foregoing in mind, it is a primary object of the present invention to provide a new and improved construction of a floor cleaning or treatment machine which does not exhibit the aforementioned drawbacks and shortcomings of the prior art constructions.

A further important object of the present invention is to provide a floor cleaning or treatment machine of the abovementioned type in which the power consumption and therefore the drivng torque of the electric motor are essentially constant, but wherein the rotary speed of the support disc automatically adapts to operating conditions, such as the type of cleaning or treatment tool and the surface properties of the floor or surface being treated.

Now in order to implement these and still further objects of the invention, which will become more readily apparent as the description proceeds, the floor cleaning or treatment machine of the present invention is manifested by the features that the drive train comprises a friction transmission drive means which automatically alters the rotary or rotational speed of the rotatably drivable support disc in accordance with the turning moment or operating torque required by the support disc with a constant driving torque of the electric motor.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein:

FIGS. 5 and 6 respectively schematically show a top plan view and side view of those elements which connect the shaft of the electric motor to that of the driving friction wheel of the friction drive of the machine according to FIG. 1.

DETAILED DESCRIPTION OF THE PREFERRED EMBODIMENTS

Figure 1:
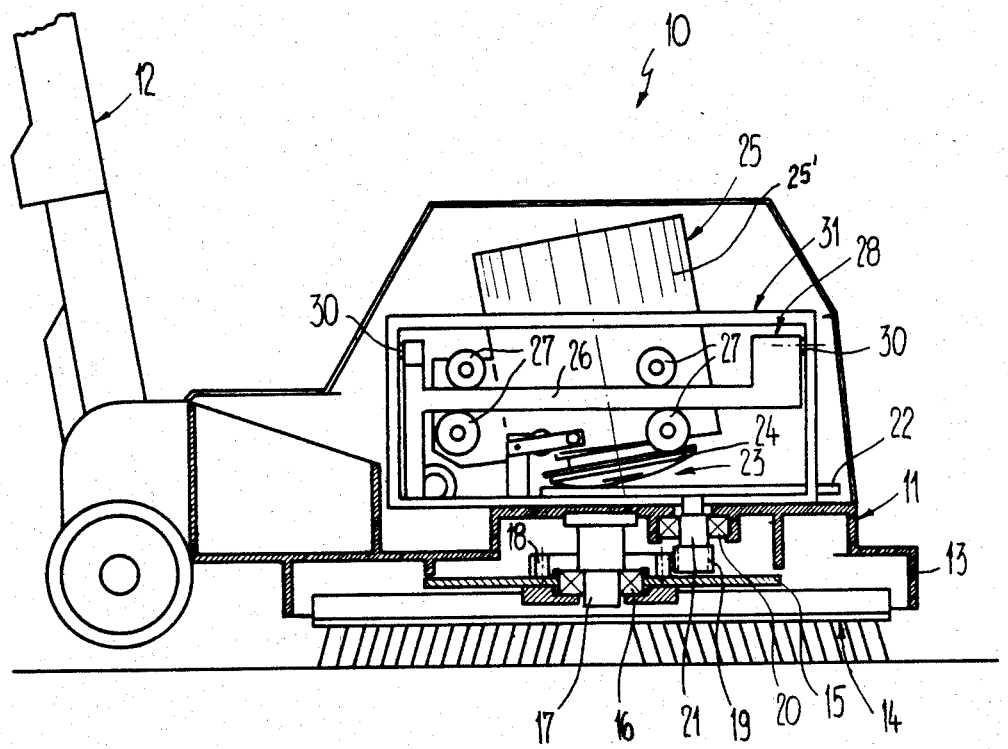
FIG. 1 schematically shows a vertical section through an exemplary embodiment of a floor cleaning or treatment machine.
Figure 2:
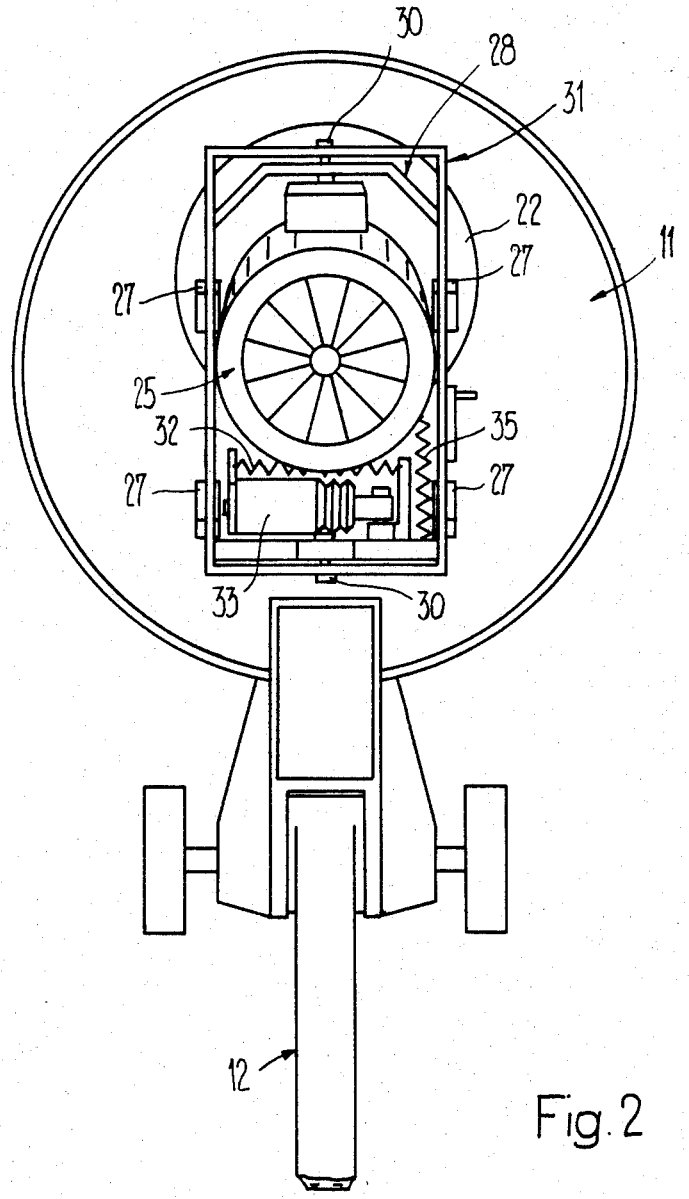
FIG. 2 shows a top plan view of the machine according to FIG. 1 with the cover removed.

Describing now the drawings, it is to be understood that to simplify the showing thereof, only enough of the structure of the apparatus for a floor cleaning or treatment machine has been illustrated therein as is needed to enable one skilled in the art to readily understand the underlying principles and concepts of the present invention. Turning now specifically to FIG. 1 of the drawings, the apparatus illustrated therein by way of example and not limitation will be seen to comprise a floor cleaning machine 10 possessing a base frame or chassis 11 to which an operating and control handle or shaft 12 is fastened in any suitable and thus here not further shown manner. The control handle 12 is fastened such that it is appropriately pivotable about a limited arc of swing.

An essentially circularly round flange or skirt 13 is formed at the base frame 11 such that it projects downwardly and surrounds with play a cleaning tool or implement, here a disc brush 14. The disc brush 14 is conventionally fixed, in a manner not here particularly shown, to the underside of a support disc 15 to rotate therewith yet to be exchangeable for cleaning tools of other types. The support disc 15 is rotatably mounted through an anti-friction bearing 16 to a stub shaft 17 which projects downwardly and is in turn anchored to the base frame 11. An externally toothed ring gear 18 is fastened to the top of the support disc 15 and meshes with a pinion 19. The ratio between the pinion 19 and the ring gear 18 may be, for instance, 1:8. The pinion 19 is seated on a shaft 21 which is rotatably mounted by means of an anti-friction bearing 20 and extends through the base frame 11. At the end of the shaft 21, which extends through the base frame 11, there is seated a substantially planar or flat friction disc or driven friction wheel 22 which constitutes the driven wheel of a friction wheel drive 23. A driving friction wheel of the friction wheel drive 23, designated by reference numeral 24, is connected to a shaft of a drive motor or drive means 25, for instance an electric motor, in a manner to be described hereinbelow. Thus, the friction wheel drive 23 as well as the gear reduction train composed of the pinion 19 and ring gear 18 form the drive train between the motor 25 and the support disc 15.

Figure 3:
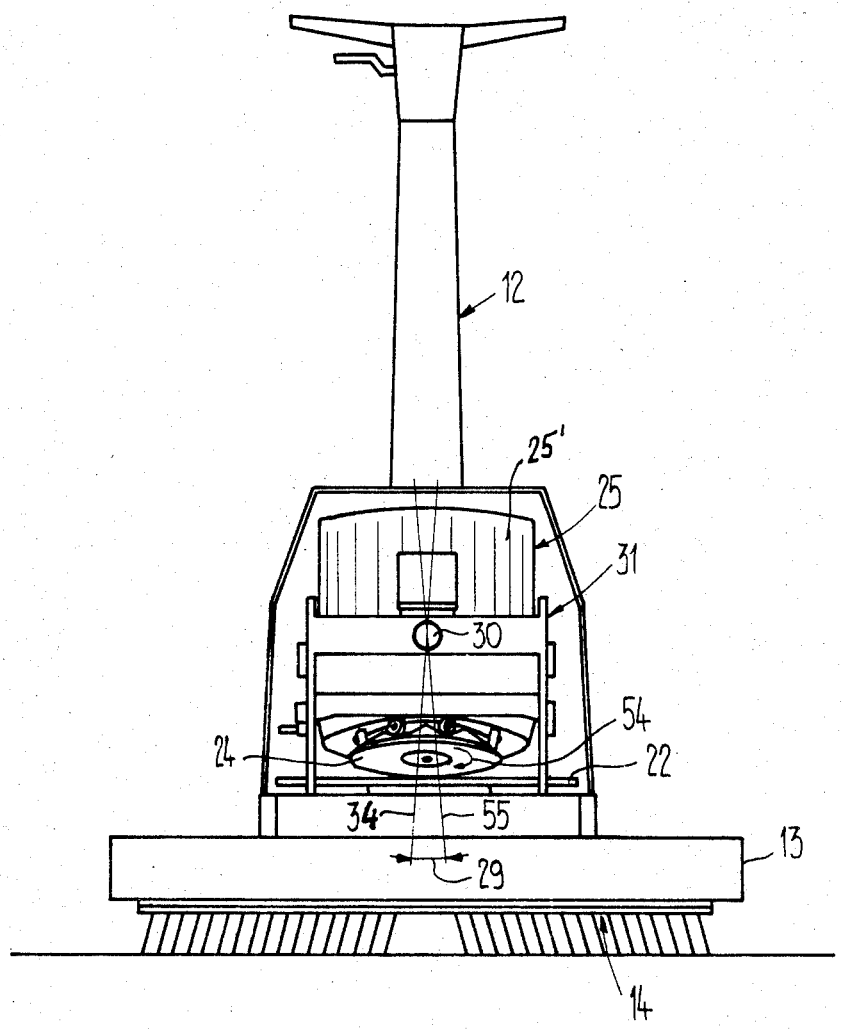
FIG. 3 schematically shows a frontal view of the machine according to FIG. 1, wherein the front side of the cover is shown in section.

The drive motor 25 and with it the driving friction wheel 24 of the friction wheel drive 23 are guided toward and away from the rotating shaft 21 of the pinion 19 by means of rails or tracks 26 which are arranged at either side of the casing or housing 25' of the motor 25 and rollers 27 running thereon. The rollers 27 are operatively connected with the casing or housing 25' of the drive motor 25 to allow for the aforementioned guided movement of such drive motor 25. The rails 26 are elements of a secondary frame 28 which, in turn, is pivotable through a limited angle 29 about a shaft 30 carried on a frame 31, as shown in FIG. 3. The frame 31 is anchored to the base frame 11. A first return spring 32, which cooperates with a shock absorber 33, holds the secondary frame 28, when the drive motor 25 stops, in the pivoted or tilted position in which the shaft 36 of the drive motor 25 extends in the direction of the line 34 of FIG. 3. The pre-loading or biasing of this first return spring 32 is adjustable and fixable in position for a purpose yet to be described. A second return spring 35 tends to maintain the motor 25, and with it the driving friction wheel 24, at the greatest distance from the pinion 19.

Figure 4:
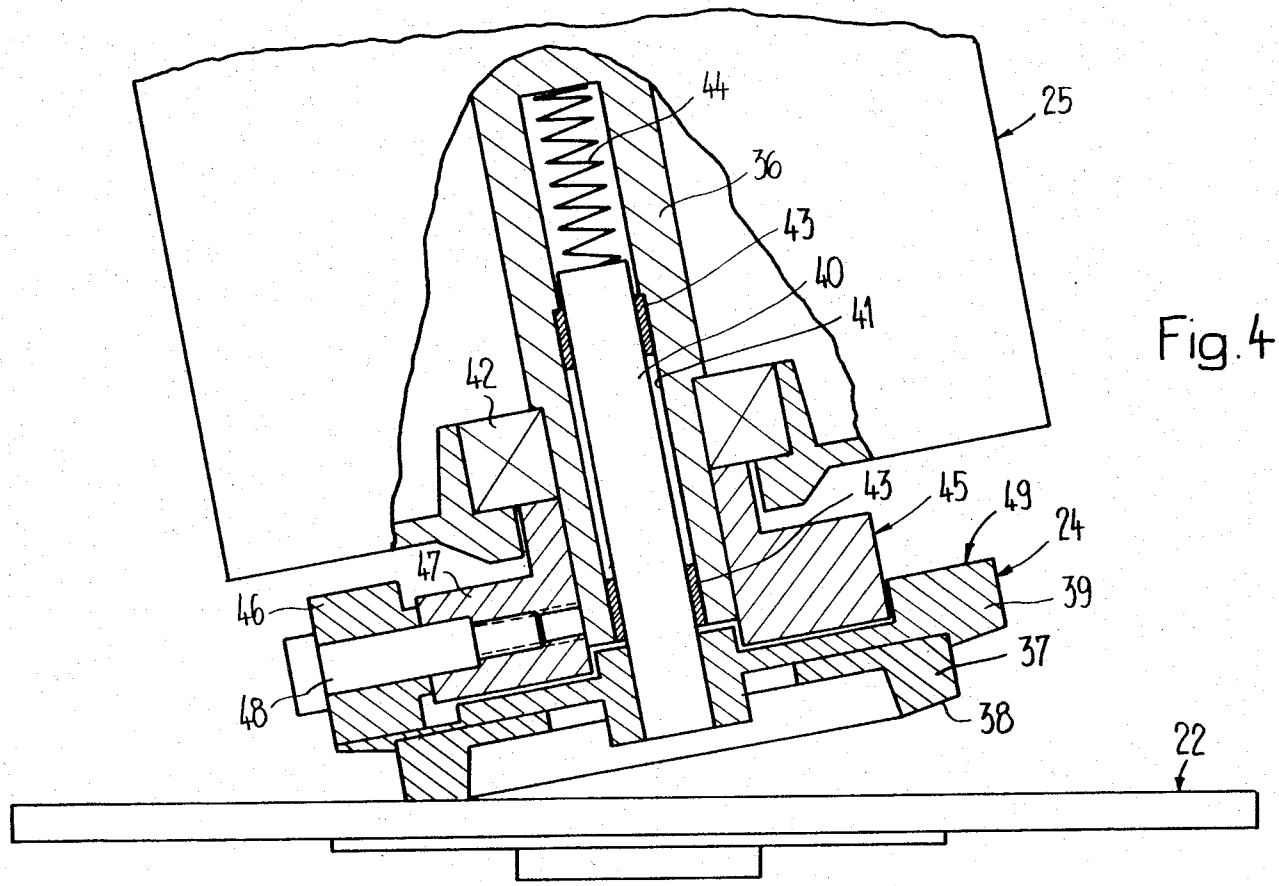
FIG. 4 shows, on an enlarged scale, important components of the friction wheel drive of the machine according to FIG. 1.

Reverting now to FIG. 4 there can be schematically seen the driven friction wheel 22 with its substantially planar or flat friction surface, the motor 25 with a motor shaft 36 mounted on anti-friction bearings 42, and the driving friction wheel 24. The driving friction wheel 24 possesses a substantially annular friction liner or facing 37, whose friction surface 38 is in contact with the driven friction wheel 22 and has the shape of a flat or squat frustum of a cone. The friction liner or facing 37 is fixedly anchored to a carrier or support disc 39 which, in turn, is seated at the end of a shaft 40. The shaft 40 is coaxial with the motor shaft 36 and extends into a bore 41 machined in the motor shaft 36 and is mounted by means of bearing bushes 43, as will be explained hereinbelow, such that it has limited rotational freedom and is axially displaceable. A compression spring 44 acts upon that end of the shaft 40 which is furthest from the carrier disc 39 and thus forces or pushes this carrier disc 39 and with it the friction liner or facing 37 into contact with the driven friction wheel 22.

Furthermore, there can be seen from FIG. 4 that on the projecting end of the motor shaft 36 there is anchored a transmission element which in its entirety is generally designated by reference numeral 45 and which with the end remote from the friction liner or facing 37 cooperates with the carrier or support disc 39. As can also be seen from FIGS. 5 and 6, this transmission element 45 possesses a plurality of, in the present instance, five rollers 46 which are arranged mutually circumferentially equidistant. These rollers 46 are freely rotatably mounted on journals 48 projecting essentially at right angles to the shafts 36 and 40. These journals 48 are formed as shouldered pins which are screwed into a body 47 of the transmission element 45. For the sake of simplicity, conventional anti-friction bearings or bushings, by means of which the rollers 46 are mounted on the shouldered pins or journals 48, are not here particularly shown. The rollers 46 can, for example, be formed by outer races of anti-friction bearings, such as ball or roller bearings.

The rollers 46 cooperate with a substantially circularly arcuate profiled track 49 formed on the carrier disc 39 on the side remote from the friction liner 37. As can be seen from FIG. 6, the profiled track 49 possesses as many depressions or recesses 49' as there are rollers 46. Cuneiformly or wedge-shaped rising ramps 50 and 51 adjoin the depressions or recesses 49' on both sides thereof. If, for example, the motor shaft 36 and with it the transmission element 45 begin to rotate in the sense of the arrow 52 of FIG. 6, then the transmission element 45, depending on the inertia of the drivig friction wheel 24 and the resisting torque acting thereon through the driven friction wheel 22, will advance slightly. This slight advance, due to an attendant motion of the rollers 46 up onto the ramps 50, effects an additional increase in the force acting in the direction of the arrow 53 in FIG. 6. This force presses the friction surface 38 against the driven friction wheel 22, resulting in an increase of the friction force. Naturally the same effect occurs when the motor 25 rotates in the direction opposite to the arrow 52.

In has already been explained, and also shown in FIG. 3, that at rest the shaft 36 of the motor 25 and thus also the axis of the driving friction wheel 24 extend in the direction shown by line 34. If the motor 25 starts to rotate in the direction of the arrow 54, then the load of the driven friction wheel 22 with the components 14, 15, 18 and 19 which are positively or form-lockingly connected therewith and the resisting torque resulting from them will cause the motor 25 and the components 40, 24 and 25, which are coaxially connected to the motor shaft 36, to tilt about the tilting shaft 30 counter to the force of the first return spring 32 until the axes of the motor 25 and the components 40, 24, 25 connected thereto extend in the direction shown by the line 55 in FIG. 3. However, this means that the surface line or generatrix along which the friction surface 38 contacts the upper side of the driven friction wheel 22 will not coincide with a radius of the driven friction wheel 22 either when the machine is at rest or when the machine is running. This is due to the fact that the axes of the components that are coaxial with the motor shaft 36 extend skew to the axis of rotation of the driven friction wheel 22. This, in turn, has the result that the driving friction wheel 24 does not carry out a pure rolling movement, not even one modified by direct slippage, on the driven friction wheel 22 when in the operating position. In fact, besides rolling movement, the driving friction wheel 24 also carries out a lateral slippage or drifting movement which has the result that during its rotation the driving friction wheel 24 has the tendency to move in the direction of the center of the driven friction wheel 22 which, given a constant speed of rotation of the driving friction wheel 24, leads to an increase in the rotational speed of the driven friction wheel 22 and an attendant reduction of the torque transmittable therefrom.

Such an increase of the rotary or rotational speed and such a reduction of the transmittable torque is, however, related to the resisting torque to be overcome by the disc brush 14 and which is transmitted to the driven friction wheel 22. This again has the result that, as described, the pressure of the friction surface 38 on the driven friction wheel 22 and thus the friction force between these parts is increased. Consequently, during operation of the machine a type of automatic equilibrium condition is reached in which the speed of rotation of the disc brush 14 and thus the torque to be transmitted by it is optimally and automatically continually adapted to the surface to be treated or cleaned, while the driving torque derived from the motor 25, i.e. the power consumption of the motor 25, remains constant.

By changing the biasing or pre-loading of the first return spring 32, the power transmitted by the friction wheel drive 23 can be adapted to the nominal power of the drive motor 25. If this pre-loading is increased, then the tilting of the drive motor 25 when starting cannot be prevented but the pressing force of the friction surface 38 is increased on the driven friction wheel 22 and thereby the amount of torque transmittable which, in the last analysis, depends on the allowable power requirement of the drive motor 25. In contradistinction, the second return spring 35 serves to remove the driving friction wheel 24 from the center of the driven friction wheel 22 after the drive motor 25 is switched off. Thus, when the drive motor 25 is started again, this permits the driven friction wheel 22 to experience a gentle start-up with the lowest rotational speed, corresponding, for example, to 140 rpm. of the disc brush 14, and only thereafter increasing the rotational speed in relation to the resisting torque to be overcome. This return movement of the switched-off drive motor 25 by the second return spring 35 is facilitated by the fact that the friction force between the friction liner 37 and the driven friction wheel 22 is only derived from the compression spring 44, while the cooperation of the rollers 46 with the profiled track 49 is interrupted.

While there are shown and described present preferred embodiments of the invention, it is to be distinctly understood that the invention is not limited thereto, but may be otherwise variously embodied and practiced within the scope of the following claims.

Accordingly, what we claim is:

1. A floor treatment machine, such as a floor cleaning machine, a floor polishing machine or the like, comprising:

an electric motor possessing a substantially constant driving torque;

a base frame;

at least one floor treatment implement;

at least one drivable support disc operatively mounted at said base frame for exchangeably accommodating said at least one floor treatment implement and for applying said driving torque of said electric motor to said at least one floor treatment implement;

a drive train operatively connecting said electric motor to said at least one drivable support disc for driving said at least one drivable support disc at a variable rotational speed; and said drive train including friction transmission drive means for automatically altering said variable rotational speed of said at least one drivable support disc in dependence upon said driving torque applied by said electric motor to said at least one drivable support disc.

2. The floor treatment machine as defined in claim 1, wherein:

said friction transmission drive means comprises a friction wheel drive means;

said friction wheel drive means including a driven friction wheel having a central axis and operatively coupled with said at least one drivable support disc by a portion of said drive train;

said friction wheel drive means further including a driving friction wheel connected to the electric motor and cooperating with said driven friction wheel; and means for displaceably mounting said driving friction wheel in relation to said central axis of said driven friction wheel.

3. The floor treatment machine as defined in claim 2, wherein:

said driven friction wheel has a substantially planar friction surface; and said driving friction wheel has a substantially frustroconical friction surface coacting with said substantially planar friction surface.

4. The floor treatment machine as defined in claim 3, further including:

a first return spring for exerting a return force;

said driving friction wheel having a cental axis extending in a skewed direction relative to said central axis of said driven friction wheel both in an idle position and in a range of drive positions of said driving friction wheel and extending eccentric to said central axis of said driven friction wheel in said idle position;

means for enabling said driving friction wheel to be forced against the action of said return force of said first return spring to a predetermined side of said central axis of said driven friction wheel upon initiation of operation of the floor treatment machine; and said driven friction wheel and said driving friction wheel being arranged in relation to one another such that said driving friction wheel tends to move toward said central axis of said driven friction wheel.

5. The floor treatment machine as defined in claim 4, wherein:

said first return spring comprises a fixably adjustably pre-loadable spring means.

6. The floor treatment machine as defined in claim 4, further including:

a second return spring;

said enabling means including a secondary frame fitted inside said base frame;

said enabling means further including tilting shaft means fitted inside said base frame;

said secondary frame being tiltable about said tilting shaft means;

said tilting shaft means extending substantially at right angles to said central axis of said driven friction wheel;

said secondary frame being tiltable about said tilting shaft means against the action of said second return spring;

said driven friction wheel having an axis of rotation defined by said central axis; and said driving friction wheel being displaceably mounted conjointly with said electric motor in said secondary frame and subject to the action of said second return spring in the direction of said central axis of said driven friction wheel.

7. The floor treatment machine as defined in claim 3, further including:

means for increasing the pressure of said substantially frustro-conical friction surface of said driving friction wheel on said substantially planar friction surface of said driven friction wheel in a manner essentially corresponding to a resisting torque of said driven friction wheel that is to be overcome.

8. The floor treatment machine as defined in claim 7, wherein:

the electric motor includes a motor shaft;

said driving friction wheel including a shaft;

a substantially circularly annular profiled track fixedly anchored to said driving friction wheel and substantially coaxial therewith;

said motor shaft of the electric motor and said shaft of said driving friction wheel being arranged substantially coaxial with respect to each other and being axially displaceable with respect to each other;

said motor shaft of the electric motor including a transmission element having a circumference;

said transmission element including a ring of rollers projecting away from said transmission element and essentially at right angles to said motor shaft and being substantially equidistantly spaced along said circumference of said transmission element;

said substantially circularly annular profiled track having at least one ascending ramp segment and at least one descending ramp segment; and said ring of rollers cooperating with said substantially circularly annular profiled track.

9. The floor treatment machine as defined in claim 8, wherein:

said motor shaft of the electric motor has a bore;

a carrier disc and friction liner;

said driving friction wheel including said friction liner cooperating with a first side of said carrier disc;

said friction liner defining said substantially frustro-conical friction surface;

said shaft of said driving friction wheel having a first end and a second end;

said carrier disc being seated at said first end of said shaft of said driving friction wheel; and said second end of said shaft of said driving friction wheel extending into said bore of said motor shaft such that said motor shaft is axially displaceable within said bore and its rotation is limited to a predetermined degree within said bore.

10. The floor treatment machine as defined in claim 9, further including:

a compression spring arranged within said bore of said motor shaft of said electric motor; and said compression spring acting upon said second end of said shaft of said driving friction wheel in the direction of said driven friction wheel.

* * * * *

UNITED STATES PATENT AND TRADEMARK OFFICE

CERTIFICATE OF CORRECTION

PATENT NO. : 4,651,378

DATED : March 24, 1987

INVENTOR(S) : CHARLES MATHIEU SèROU et al

It is certified that error appears in the above-identified patent and that said Letters Patent is hereby corrected as shown below:

on first page, line [73] please delete "Sweden" and insert --Switzerland-- at the end of the line Signed and Sealed this First Day of September, 1987

*Attest:*

*Attesting Officer*

DONALD J. QUIGG

*Commissioner of Patents and Trademarks*